US006322732B1

(12) United States Patent
Bowen et al.

(10) Patent No.: US 6,322,732 B1
(45) Date of Patent: Nov. 27, 2001

(54) METHOD FOR FINISHING PRE-PRINTED PAPER FROM MULTIPLE WEBS

(75) Inventors: Reed Bowen, Flowery Branch; Daniel Winfield Leidig, Jr., Suwanee, both of GA (US)

(73) Assignee: Dittler Brothers Incorporated, Atlanta, GA (US)

( * ) Notice: Subject to any disclaimer, the term of this patent is extended or adjusted under 35 U.S.C. 154(b) by 0 days.

(21) Appl. No.: 09/430,679

(22) Filed: Oct. 29, 1999

(51) Int. Cl.[7] ..... B29C 55/06; D21G 1/00

(52) U.S. Cl. ..... 264/40.1; 100/38; 100/43; 100/334; 162/206; 264/288.8; 264/289.6

(58) Field of Search ..... 264/40.1, 280, 264/288.4, 288.8, 289.6; 162/206; 100/38, 43, 334

(56) References Cited

U.S. PATENT DOCUMENTS 4,712,686 12/1987 Lancaster et al. .

5,483,873 * 1/1996 Koivukunnas et al. ..... 100/38

6,003,440 * 12/1999 Koskinen et al. ..... 100/35

* cited by examiner

*Primary Examiner*—Leo B. Tentoni

(74) *Attorney, Agent, or Firm*—Dean W. Russell; Kilpatrick Stockton LLP

(57) ABSTRACT

Reformation techniques and apparatus. Typically employed to permit separate printing and finishing of multiple webs of paper, these techniques and apparatus utilize or provide heat and, in some cases, initial tension, to change dimensions (including repeat length) of the paper of one or more webs. Webs dimensionally-reformed in accordance with the techniques typically do not require subsequent variation of tension to maintain appropriate dimension, permitting any such tension variation to occur solely to enhance other aspects of the finishing processes.

6 Claims, 1 Drawing Sheet

Figure
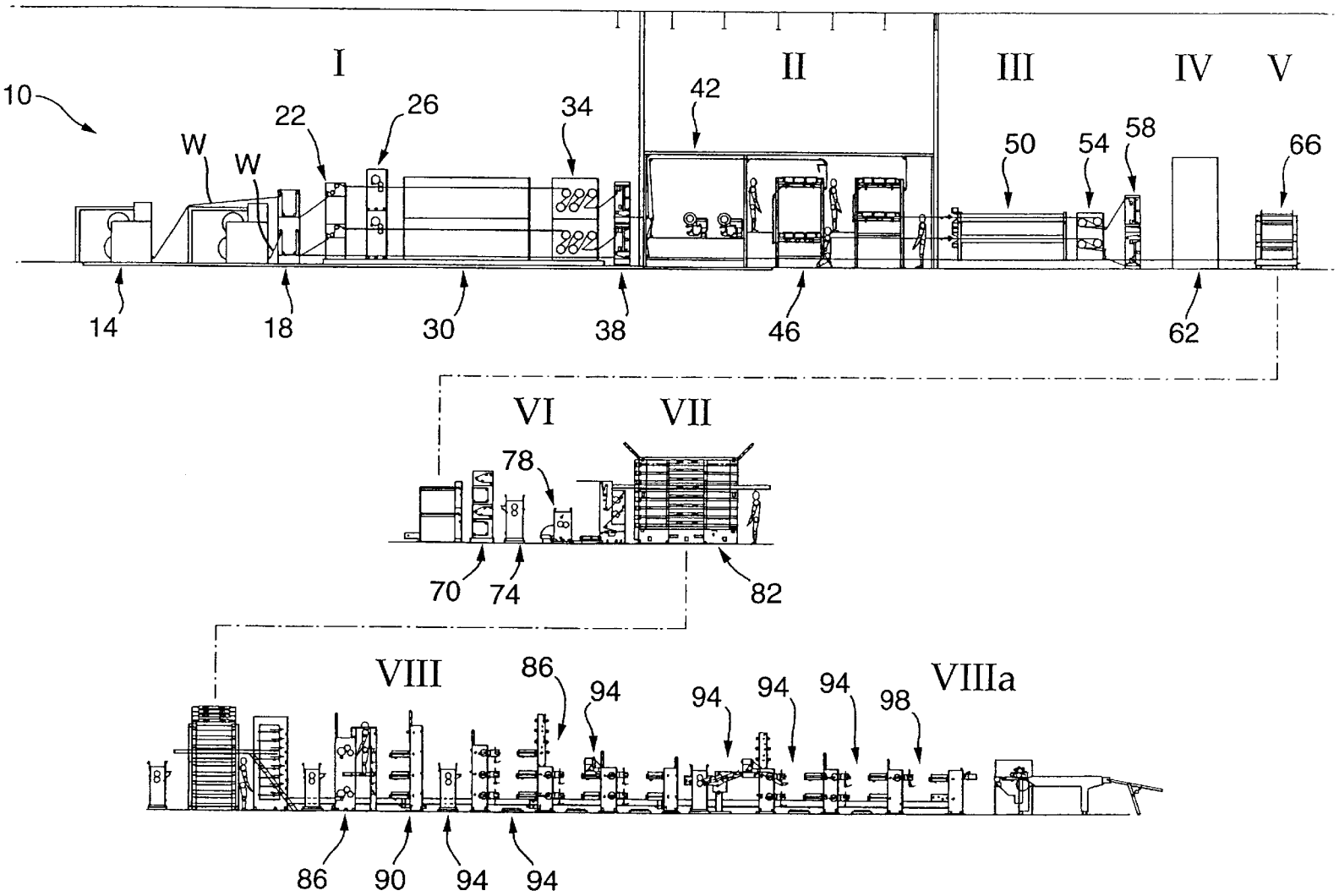

METHOD FOR FINISHING PRE-PRINTED PAPER FROM MULTIPLE WEBS

FIELD OF THE INVENTION

This invention relates to apparatus and methods for finishing paper (or other materials) from multiple webs and in particular to registering, or matching, paper which has been preprinted by heating and reforming one or more of the webs.

BACKGROUND OF THE INVENTION

Many characteristics of paper conventionally employed in printing processes are unstable. One set of such characteristics is the dimensions of the paper, and in particular the length and width. These dimensions change as functions of heat, moisture, and tension, for example, creating potential difficulties in registering repeated patterns appearing on two or more webs which, at some point, have been processed differently.

Historically, dimensional instability of paper has not caused any significant problem for the printing industry. This is because the problem largely can be avoided merely by simultaneously printing and finishing multiple webs, thereby subjecting the webs to essentially the same heat, moisture, tension, and other environmental and equipment-related factors. A recognized drawback, of course, is the limited number of colors available to printing on the webs, as use of the available print stations must be divided to service the two (or more) webs.

Prior attempts to resolve this issue have involved continual varying of the tension on the webs throughout the finishing line. In other words, variably-increased tension is applied throughout the process to cause the shorter or narrower patterns on the webs to match the longer or wider ones. While theoretically capable of matching certain characteristics of webs, these tension-oriented attempts typically have been disadvantageous, in that they disrupt aspects of the finishing process such as (but not necessarily limited to) folding, gluing, and die-cutting of the webs.

SUMMARY OF THE INVENTION

The present invention, by contrast, overcomes the limitations described above without resort to continual varying of the tension on one or more webs for purposes of matching the lengths and widths of aspects of multiple webs. Instead, the invention utilizes heat to reform smaller webs at desired dimensions. Although usually coupled with an initial increase in the tension of the smaller web, unlike prior efforts such increased tension is not required throughout the finishing process and, in some cases, is not required at all.

Once reformed, the paper or other webs usually retain their increased dimensions for a period sufficient to complete the printing and finishing processes. As a consequence of employing the present invention, therefore, papers of different types may be utilized as the multiple webs yet still have substantially-identical repeat lengths. Printing, furthermore, may occur at a time or location (or both) remote from the finishing line, thus avoiding any need to divide available print stations in order simultaneously to print multiple webs. Indeed, certain registration-related printing errors can be corrected through the present invention, thus relaxing the specifications of repeat lengths and other parameters which the printing must meet. Likewise advantageous is that any tension adjustments to the webs after reformation may be made simply to facilitate the finishing processes, rather than to maintain printed matter in registration.

In some embodiments of the invention, feedback loops also are used beneficially during the initial reformation. Such feedback typically results from monitoring the dimensions of the multiple webs and can be used to adjust the tension present on one or more of the webs. If registration of printed matter does not occur through mere initial tensioning of the webs, information from the feedback loop can be used to activate heaters to facilitate the paper-reformation process.

It thus is an object of the present invention to provide apparatus and methods of matching multiple webs.

It also is an object of the present invention to provide apparatus and methods of registering printed matter on multiple webs of paper through use of heat to reform dimensions of one or more of the webs.

It additionally is an object of the present invention to provide registration techniques not dependent on continual varying of tension on webs to change their lengths and widths.

It is another object of the present invention to permit pre-printing of webs, thereby avoiding any need to divide available print stations in order simultaneously to print multiple webs.

It is a further object of the present invention to provide apparatus and methods permitting employment of different types of paper yet maintaining ability to register their repeat lengths.

It is yet another object of the present invention to monitor characteristics of webs under tension and employ feedback loops to adjust that tension and, possibly, to activate heaters whose heat will be incident upon the webs.

Other objects, features, and advantages of the present invention will be apparent with reference to the remainder of the text and the drawing of this application.

BRIEF DESCRIPTION OF THE DRAWING

The FIGURE is a schematicized view of an exemplary finishing line adapted to exploit principles of the present invention.

DETAILED DESCRIPTION

Illustrated in the FIGURE is, as noted immediately above, an exemplary finishing line 10. Line 10 is divided into eight zones, each performing one or more functions typically associated with finishing multiple webs of paper or other materials. Zone 1, for example, serves as the input station for line 10, offering splicing equipment 14 and infeed units 18 sufficient to present multiple webs W for finishing. Webs W usually comprise elongated streams of paper pre-printed with fixed repeats, although additional printing can occur on line 10 and webs W need not necessarily be formed of paper. The material of each web W, furthermore, need not be identical to that of other webs W.

Because the present invention permits various webs W to be printed off-line (even remotely), possibly using different equipment or in different environments, dimensions (including repeat lengths) of individual webs W may differ even if intended to be the same. Accordingly, Zone 1 of line 10 additionally provides equipment useful for reforming one or more webs W as necessary or appropriate to match dimensions (including repeat lengths) of other webs W. Such equipment may include moisture applicators 22 and 26 as well as dryers 30. Also included in Zone 1 as shown in the FIGURE are chillers 34 and guides 38, each set of which are optional components of line 10.

When present, applicators 22 and 26 may be used to moisten one or more webs W before heating in dryers 30. Doing so reduces the likelihood of the webs W being overdried or becoming unusually brittle when heated. Moistening of webs W is not absolutely required, however, so applicators 22 and 26 likewise constitute optional components of line 10.

Commercially-available, microprocessor-based controls can be used to measure the lengths of the printed repeating patterns on webs W and, to some extent, control them through varying the tension setting of one or more infeed units 18. Sensors associated with these controls may be located at any desired locations in line 10, although they typically measure the repeat after webs W have passed through chillers 34. Such sensed measurements are then processed, with appropriate instructions thereafter being passed back to the tension settings of the infeed units 18.

Although some control of dimensions of webs W can be achieved through varying these tension settings, preferred performance of line 10 often is achieved, and webs W are less likely to break, when the settings are retained within predetermined limits. Additional (and, in some cases, predominate) control of the repeat of webs W is accomplished by using dryers 30 to heat one or more of the webs W with shorter repeats to at least a temperature at which they become pliable. Once pliable, the heated webs W stretch (because under tension) as desired to match the repeat lengths (or other dimensions of interest) of the other one or more webs W. Thereafter passing webs W through chillers 34 effectively fixes their dimensions for the remainder of the processes performed on line 10, permitting any subsequent tension variations in Zones 2–8 to occur for process considerations rather than to maintain the matching of the repeats of the webs W.

Illustrated in Zones 2–8 of the FIGURE are various other equipment which optionally may comprise exemplary line 10. Although similar lines likely will include at least some of the equipment detailed in Zones 2–8, they need not include any or all of such equipment in order to be encompassed by the present invention. Nevertheless, for exemplary line 10, labelling and duplex imaging equipment 42 and 46, respectively, are shown as being present in Zone 2, while included in Zone 3 are infrared dryers 50 and chillers 54. Zone 4 may incorporate web guide 58 and ultraviolet flexographic equipment 62, with Zone 5 providing angle bars 66 or other suitable means for changing the direction of webs W.

The FIGURE further details Zone 6 of line 10 as containing guides 70, die-cutting equipment 74, and perforating equipment 78, the latter functioning to divide webs W into ribbons for further processing. Zone 7 includes equipment 82 for segregating the various ribbons as desired, with Zone 8 containing mechanisms such as gluers 86, die-cutting equipment 90, plows 94, and slitters 98. As noted above, however, line 10 need not necessarily include any of the equipment of Zones 2–8, and those skilled in the art will recognize numerous ways to revise or recreate line 10 consistent with the invention.

Whereas existing matching techniques can accommodate differences of approximately five thousandths of an inch (0.005") in the repeats of paper webs while maintaining registration, those of the present invention can effect changes of approximately twenty-seven thousandths of an inch (0.027"). This represents improvement of greater than one order of magnitude over existing techniques, a significant enhancement of the art. Likewise, while existing methods can stretch paper lengths about three hundredths of a percent (0.03%), those of the present invention can do so by about fifteen hundredths (0.15%). The table below presents additional information about tests conducted in connection with the invention.

PRE-PRINT LENGTH SETTING TEST, PRESS 44

| TEST No. | SUBSTRATE | INFEED TENSION | No. of WATER UNITS ON | DRYER WEB EXIT TEMP | CHILL TENSION | LENGTH IN ROLL | LENGTH AFTER SETTING |
|---|---|---|---|---|---|---|---|
| 1 | 70 LB C2S | 240 | 2 | 210 | 30 | 106 17/32 | 106 22/32 |
| 2 | 70 LB C2S | 150 | 2 | 210 | 27 | 106 17/32 | 106 19/32 |
| 3 | 70 LB C2S | 240 | 1 | 210 | 30 | 106 17/32 | 106 22/32 |
| 4 | 70 LB C2S | 240 | 0 | 210 | 30 | 106 17/32 | 106 22/32 |
| 5 | 70 LB C2S | 240 | 0 | OFF | 30 | 106 18/32 | 106 19/32 |
| 6 | 70 LB C2S | 240 | 1 | OFF | 30 | 106 18/32 | 106 18/32 |
| 7 | 70 LB C2S | 240 | 2 | OFF | 30 | 106 18/32 | 106 19/32 |
| 8 | 70 LB C2S | 240 | 0 | 210 | 30 | 106 18/32 | 106 22/32 |
| 9 | 9 PT C2S | 250 | 0 | 210 | 40 | 106 21/32 | 106 20/32 |
| 10 | 9 PT C2S | 275 | 0 | 210 | 40 | 106 21/32 | 106 21/32 |
| 11 | 9 PT C2S | 275 | 2 | 210 | 40 | 106 21/32 | 106 22/32 |
| 12 | 9 PT C2S | 275 | 2 | 260 | 36 | 106 21/32 | 106 45/64 |
| 13 | 9 PT C2S | 275 | 2 | 260 | 36 | 106 21/32 | 106 23/32 |
| 14 | 9 PT C2S | 275 | 2 | 300 | 33 | 106 21/32 | 106 23/32 |
| 15 | 9 PT C2S | 275 | 0 | 300 | 33 | 106 21/32 | 106 23/32 |
| 16 | 9 PT C2S | 175 | 0 | 300 | 33 | 106 20/32 | 106 20/32 |
| 17 | 50 LB OFFSET | 150 | 0 | 210 | 36 | 106 19/32 | 106 20/32 |
| 18 | 50 LB OFFSET | 250 | 0 | 210 | 33 | 106 19/32 | 106 21/32 |
| 19 | 50 LB OFFSET | 250 | 0 | 260 | 30 | 106 19/32 | 106 24/32 |

All tests were performed at 250 FPM.

Material was pre-printed Apr. 17, 1999.

Throw length at time of printing was 106 17/32" for all stocks (six 17.750" impressions).

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A method of reforming a dimension of a web of paper comprising:

a. tensioning the web;

b. while the web is tensioned, heating it until it is pliable; and c. chilling the pliable web to fix the dimensional change.

2. A method according to claim 1 further comprising moistening the web before it is heated.

3. A method according to claim 1 further comprising sensing the dimension of the web and adjusting the tension under which it is placed.

4. A method according to claim 3 in which sensing the dimension of the web occurs after the web is heated.

5. A method according to claim 3 in which the dimension sensed is the length of the web.

6. A method according to claim 3 in which the dimension sensed is the width of the web.

* * * * *